US006354030B1

(12) United States Patent
Harris

(10) Patent No.: US 6,354,030 B1
(45) Date of Patent: Mar. 12, 2002

(54) NESTED MAGNETIC PICTURE FRAME PIECES

(76) Inventor: Alan M. Harris, 6128 W. Sixth St., Los Angeles, CA (US) 90048

( * ) Notice: Subject to any disclaimer, the term of this patent is extended or adjusted under 35 U.S.C. 154(b) by 0 days.

(21) Appl. No.: 09/475,848

(22) Filed: Dec. 30, 1999

(51) Int. Cl.[7] ..... A47G 1/08

(52) U.S. Cl. ..... 40/711; 40/739; 248/467

(58) Field of Search ..... 40/711, 739, 791, 40/600, 621, 700, 757; 248/469, 549; 298/467

(56) References Cited

U.S. PATENT DOCUMENTS

| | | | | | |
|---|---|---|---|---|---|
| 1,506,215 | A | | 8/1924 | Beshgetoor | |
| 3,826,026 | A | * | 7/1974 | Bevan | 40/10 B |
| 3,885,336 | A | | 5/1975 | Olsen | 40/152 |
| 4,023,290 | A | * | 5/1977 | Josephson | 40/125 F |
| 4,605,292 | A | * | 8/1986 | McItosh | 350/641 |
| 4,663,874 | A | * | 5/1987 | Sano et al. | 40/621 |
| 4,738,390 | A | * | 4/1988 | Brennan | 229/77 |
| 4,785,562 | A | | 11/1988 | Good | 40/159 |
| 4,852,282 | A | | 8/1989 | Selman | 40/159 |
| 4,912,864 | A | | 4/1990 | Price | 40/155 |
| 5,050,834 | A | | 9/1991 | Tardiff | 248/467 |
| 5,261,174 | A | | 11/1993 | Blegen | 40/152 |
| 5,303,489 | A | | 4/1994 | Blegen | 40/152 |
| 5,375,351 | A | | 12/1994 | King et al. | 40/124 |
| 5,549,938 | A | * | 8/1996 | Nesbitt | 428/17 |
| 5,666,712 | A | * | 9/1997 | Cvetkov | 40/711 |
| 5,699,956 | A | * | 12/1997 | Brennan | 229/92.8 |
| 5,918,400 | A | * | 7/1999 | Schonberger | 40/711 |

* cited by examiner

*Primary Examiner*—Lynne H. Browne
*Assistant Examiner*—Kenn Thompson
(74) *Attorney, Agent, or Firm*—Darby & Darby

(57) ABSTRACT

A set of nested magnetic picture frames elements is disclosed for defining multiple picture frames from a single sheet of magnetic material. The sheet of magnetic material is diced into a plurality of frame elements and supports a printed background or image on a front surface thereof. Portions of the background can be selectively removed from the sheet to define a custom picture frame with non-overlapping edges. The invention also provides a method for creating a custom nested magnetic picture frame product. The method includes the steps of receiving a photograph or other item from a customer, applying that item to a sheet of magnetic material, then dicing the sheet, and applying a tie layer to the diced sheet so that the original composition of the photograph or item is maintained during transportation and display of the picture frame.

9 Claims, 2 Drawing Sheets

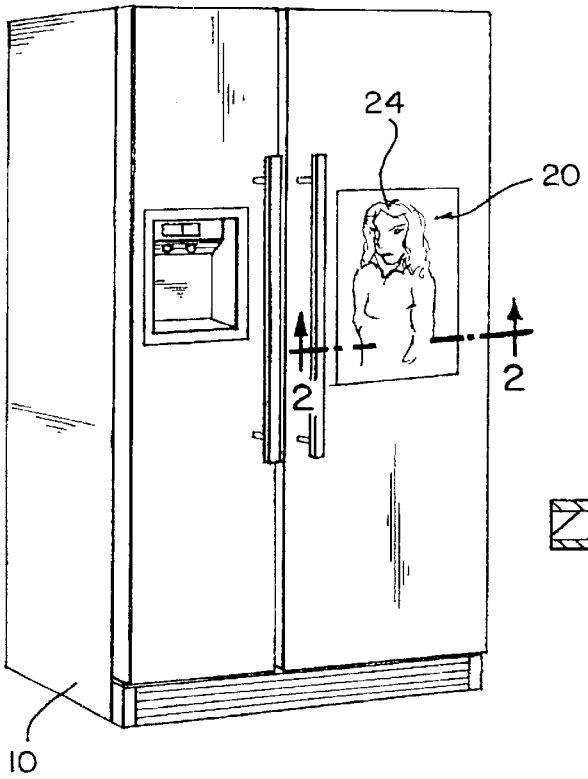
FIG. 1
FIG. 2
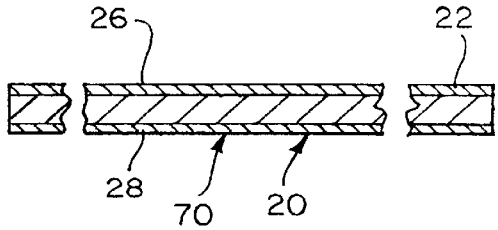
FIG. 3
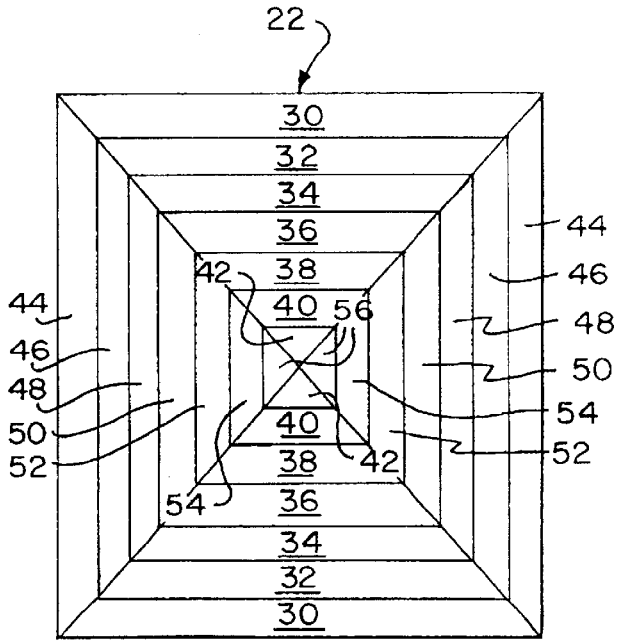

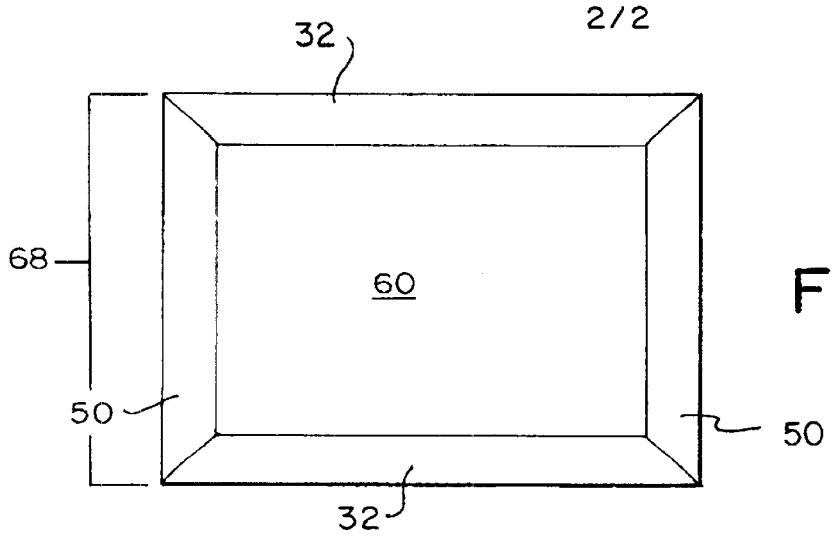
FIG. 4
FIG. 5
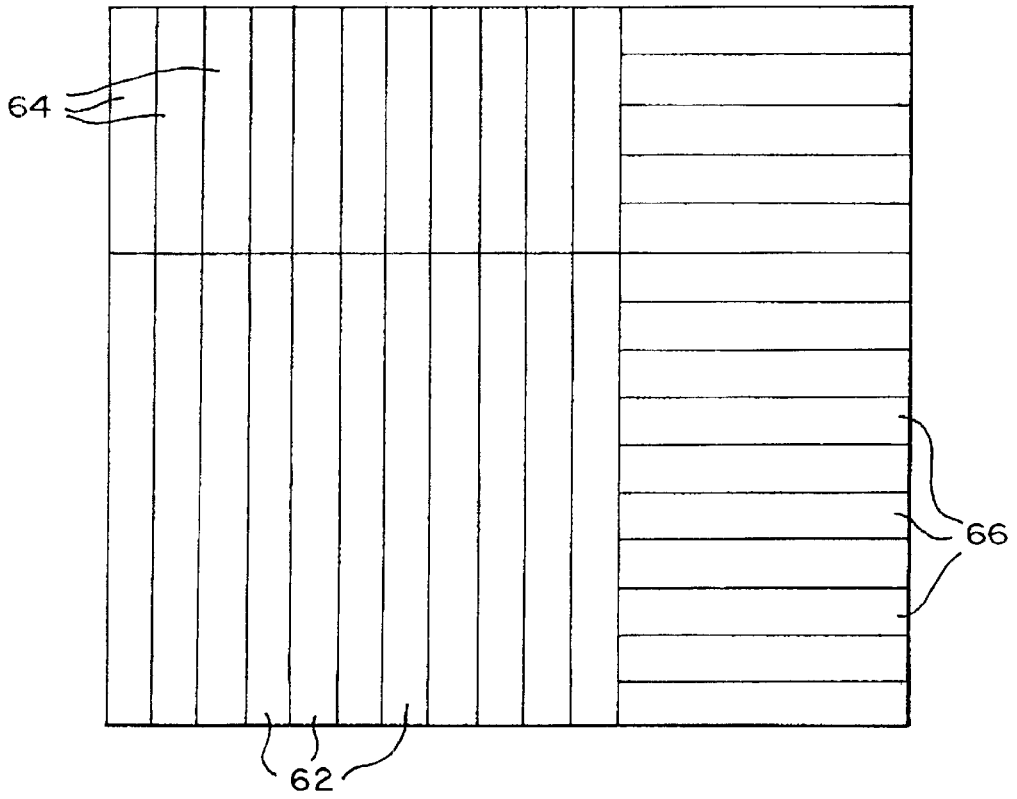

NESTED MAGNETIC PICTURE FRAME PIECES

FIELD OF THE INVENTION

The present invention relates to refrigerator magnets, and more particularly, to nested magnetic picture frame pieces that collectively support an image thereon.

BACKGROUND OF THE INVENTION

It is common practice to adorn the exterior of common household appliances such as refrigerators with photographs, drawings, and lists which are typically adhered to the appliance surface using magnets. Refrigerator magnets take on a variety of forms but typically have sufficient strength to hold themselves to the appliance as well as one or more pictures or drawings or the like. A problem perceived with the use of ordinary refrigerator magnets to secure objects to appliances is that the appliance has a sloppy appearance. Another problem is the high cost of each of the magnets necessary to secure objects to appliances.

Typically, a decorative refrigerator magnet has a magnetic element secured by glue to a back surface or within a recess of a plastic or wood handle. The handle can take on a variety of forms and may be carved or simple in its shape and may be painted, printed, and/or molded.

The prior patent literature in this field includes, but is not limited to, the following documents:

U.S. Pat. No. 1,506,215 discloses an adhesive-backed cardboard strips in overlapping, non-overlapping, and miter-corner arrangements. The strips are attached around the photo, with the photo itself comprising the back of the frame.

U.S. Pat. No. 3,885,336 discloses a photo frame of fixed dimension, with the photo held between cooperating magnetic and metallic elements.

U.S. Pat. No. 4,785,562 discloses a magnetic frame which may have a fixed periphery and which has independently positionable corners (FIG. 4) or sliding sides (FIG. 5). The frame itself may be made of magnetic material or may have magnets attached to a plastic or wood frame.

U.S. Pat. No. 4,852,282 discloses a magnetic frame and transparent cover for mounting a calendar to a refrigerator. The frame defines a fixed space for the calendar.

U.S. Pat. No. 4,912,864 discloses a magnetic picture frame for a refrigerator comprises plastic tubing with mitered corners, joined together by L-shaped elements. The L-shaped elements may include magnets for holding the frame to the refrigerator, or a strip of magnets can line the rear surface of the tube.

U.S. Pat. No. 5,050,834 discloses a magnetically supported frame for picture cards. The frame has a series of magnets adhered to crossbars, and molded projection to engage the edges of the picture cards.

U.S. Pat. Nos. 5,303,489 and 5,261,174, disclose a flexible frame for use on a refrigerator. The frame is formed from a single sheet of magnetic material and having a rectangular opening for viewing a picture. The frame can have an imprinted, decorative appearance.

U.S. Pat. No. 5,375,351 discloses a greeting card with magnetic picture frame which may include decorative painting or embossing 27. The frame has a defined size which corresponds to the size of the greeting card.

What is needed in the art and heretofore has not been available is an improved refrigerator magnet configuration which can frame drawings and pictures and the like in a variety of sizes. What is further needed in the art and has heretofore not been available is a sheet of magnetic material which itself is adorned with an image. The present invention satisfies these and other needs.

SUMMARY OF THE INVENTION

In accordance with the invention, pieces taken from a single sheet of magnetic material can be used to frame any standard size picture or paper, either fully or partially. In addition, multiple pictures or papers can be framed with the pieces from a single diced sheet. This is accomplished, in accordance with the present invention, through a set of nested magnetic frames elements obtained from a single, planar sheet. Importantly, the invention is extremely cost effective because there is minimal, if any, waste when die-cutting magnetic sheets.

The magnetic frame includes, in one aspect of the invention, a sheet of magnetic material which is diced into a plurality of linear frame elements. The sheet has an image supported thereon which spans the plural frame elements. A portion of the image can be selectively removed from the sheet to secure the picture, paper or other thin object to a ferromagnetic surface.

In another aspect of the invention, a set of magnetic frames for framing a picture, paper, or other thin object comprises a sheet of magnetic material having a printed background in at least one color supported thereon (e.g., black, white, etc.). The sheet is diced into a plurality of linear frame elements and the printed background spans the plural frame elements. Portions of the printed background are selectively removable from the sheet to secure the picture, paper or other thin object to a ferromagnetic surface.

In yet a further aspect of the invention, a method is provided for framing a picture, paper or other thin object to a ferromagnetic surface. The method according to this aspect of the invention includes three primary steps. First, a sheet of magnetic material having an image supported on one side thereof and which has been diced into a plurality of frame elements is provided to a user. Next, the user separates preselected a frame element from the sheet. Finally, a picture, paper, or other thin object is secured to the ferromagnetic surface using the preselected frame element.

In further respects, the invention includes a method for making a set of magnetic frames in which the image is provided by the customer for inclusion in a custom nested magnetic picture frame product. In this method, a customer provides a photograph or other item which is then applied to a sheet of magnetic material. The sheet is diced, with the photograph or item mounted in place, to define a plurality of frame elements. A tie layer is then applied to the diced frame elements so that the original composition of the photograph or item is maintained during transportation and display of the picture frame.

Further features and aspects of the invention can be appreciated from the accompanying drawing figures and following Detailed Description of the Preferred Embodiment.

Definitions

The term "standard size" refers to any widely available size for an uncropped printed photograph or commercially available stock paper, including, but not limited to: 2"×2", 2"×3", 3.5"×3.5", 3.5"×5", 4"×6", 5"×7", 8"×10", 8.5"×11", 9"×12", and 11"×14".

The term "image" refers to a two-dimensional printed representation of a subject such as an object, person or people, scenery, place, abstract art, reproductions of masterpieces, or a combination of these. The image preferably has the appearance of a painting, drawing or photograph.

The term "item" refers to a two-dimensional photograph, drawing, sketch, painting, finger painting, poem, map, list, or the like.

DESCRIPTION OF THE DRAWINGS

FIG. 1 is a perspective view of the nested magnetic picture frame according to a preferred embodiment of the invention shown mounted on a refrigerator;

FIG. 2 is a sectional view of the nested magnetic picture frame taken along line 2—2 of FIG. 1;

FIG. 3 is a rear plan view of the nested magnetic picture frame showing the dice lines which permit separation of linear frame elements in accordance with the preferred embodiment;

FIG. 4 illustrates a selection of frame elements which define a frame for an item;

FIG. 5 is a rear plan view of the nested magnetic picture frame showing an alternative set of dice lines to define frame elements of a shape which differs from that of FIG. 3.

DETAILED DESCRIPTION OF THE PREFERRED EMBODIMENT

By way of overview and introduction, FIG. 1 illustrates a refrigerator 10 as the chosen appliance for supporting a nested magnetic picture frame 20 in accordance with a preferred embodiment of the invention. As shown in FIG. 2, the picture frame 20 comprises a sheet 22 of flexible magnetic material having an image 24 supported on a front surface 26 thereof. In alternative embodiments, the picture frame 20 can support a simple printed background color such as white or blue. A back surface 28 of the sheet magnetically engages any ferromagnetic surface, such as the metal surface of a refrigerator.

With reference now to FIG. 3, one manner of dicing the sheet 22 into a plurality of nested magnetic elements 30–56 is illustrated. The magnetic elements can be selectively removed from the sheet 22 and mounted on the appliance, by magnetic attraction, to support items of various types. At the user's discretion, pieces are removed from the sheet and combined into a frame of variable size, and preferably into a standard size frame. Any one frame element can be used to mount the item to the appliance. When not in use, the frame elements are readily nested among one another in a single plane while providing a striking appearance. The nested frame elements provide a cost effective alternative to the use of several, typically intricate decorative refrigerator magnets.

The frame pieces 30–56 can be independently separated from the sheet 22 at the discretion of the user. With reference to FIG. 4, frame elements 32, 50, 32 and 50 are shown separated from the sheet 22 and positioned so that mitered corners 58 of each frame element abut one another in a single plane. The abutting frame elements 32, 50, 32 and 50 define a space 60 sp that an item can be framed in the space without overlap of the frame elements when mounted to the appliance.

The frame elements preferably extend linearly, as shown in FIGS. 3 and 4, and have a dimension suitable for framing several items in standard sizes using frame elements from a single sheet 22. The sheet 22 can be diced in a variety of ways to permit multiple standard size frames to be obtained. In FIG. 5, for example, the sheet 22' has been diced to provide a number of frame elements 62–66, each with rectangular rather than mitered corners. The frame elements 62–66 preferably are sized to be define the outer margin dimension 68 (see FIG. 4) of a user-selected frame. Thus, the frame elements 62–66 each can be 0.5" wide and can have a respective length of 6", 4.5" and 3.5." Two or more of the frame elements 62–66 can be arranged end to end to define the outer margin dimension 68. In other words, a 5"×7" photo, for example, can be framed on all four sides using two of the frame elements 62 and four of the frame elements 66. Preferably, the sheet 22 is cut into frame elements 1.5", 2", 3", 3.5" and 4.5" long to accommodate all the different frame sizes. Of course, the sheet 22 can be diced so as to define magnetic frame elements of other shapes (e.g., curved). Preferably, each of the frame elements diced from the sheet 22 exhibits symmetry in its cut lines to maximize the user's flexibility in framing an item.

The nested magnetic picture frame 20 optionally includes a tie layer 70 (see FIG. 2) which is preferably affixed to the back surface 28 of the sheet 22, but which alternatively can be affixed to the front surface of the image 24 or between the image and the front surface 26 of the sheet. The tie layer secures all of the frame elements 30–56 or 62–66 together until such time that a user separates one or more of the elements. The tie layer can be made of any flexible plastic such as polyvinyl chloride, polyethylene, or cellophane and preferably is transparent. The tie layer can be bonded to the sheet 22 or image 24 in any conventional manner as understood by those of skill in the art, including through use of an adhesive or by fusing the tie layer to the sheet or image.

In use, the tie layer 70 prevents the frame elements from inadvertently separating, thereby preserving a nice presentation of the product for display purposes. When a frame element is selected, it is preferred that the element be separated from the tie layer, with the tie layer remaining behind and associated with the rest of the nested magnetic picture frame elements.

The image 24 is preferably one which is in the public domain and which can be freely copied and applied to the sheet 22. Thus, the image can be a reproduction of Leonardo Da Vinci's Mona Lisa, as shown, or a work of other artists (e.g., Monet's Water Lilies or Van Gogh's Starry Night). Alternatively, the image can be a photograph mounted on the sheet 22. In this regard, the invention includes a method for making a set of magnetic frames in which a customer provides a photograph or other item, the item is applied to a sheet of magnetic material, the sheet is then diced into a plurality of frame elements, a tie layer is then applied to the diced frame elements so as to retain the original composition of the photograph or item. Of course, the image can be an original or a licensed reproduction. The strength of the magnetic sheet 22 varies according to its thickness. Consequently, the width of the frame elements will vary depending upon what thickness of magnetic sheet is chosen. The thinner the magnetic material, the wider the frame elements should be to hold the item. Magnetic sheets typically are from 15 to 60 millimeters thick.

While the invention has been described in connection with a preferred embodiment thereof, it is not so limited; rather, the invention is described in the context of a preferred embodiment but is defined solely by the appended claims and includes frames and methods that encompass the elements recited in the claims and equivalents thereof.

I claim:

1. A set of magnetic frames for framing a picture or paper, comprising:

a) a sheet of magnetic material, the sheet being diced into a plurality of linear frame elements; and b) an image supported on the sheet and spanning the plural frame elements, a portion of the image being selectively removable from the sheet to secure the picture or paper to a ferromagnetic surface.

2. A set of magnetic frames for framing a picture or paper, comprising:

a) a sheet of magnetic material, the sheet being diced into a plurality of linear frame elements; and b) a printed background supported on the sheet and spanning the plural frame elements, the printed background including at least one color, portions of the printed background being selectively removable from the sheet to secure the picture or paper to a ferromagnetic surface.

3. A method for framing a picture or paper to a ferromagnetic surface, comprising the steps of:

a) providing a sheet of magnetic material having an image supported on one side thereof, the sheet having been diced into a plurality of frame elements, whereon the image spans the plurality of frame elements;

b) separating preselected a frame element from the sheet; and c) securing the picture or paper to the ferromagnetic surface using the preselected frame element.

4. The method as in claim 3, including the further steps of separating additional frame elements from the sheet and securing the picture or paper to the ferromagnetic surface using said additional frame elements.

5. The method as in claim 3, wherein the frame elements are nested in a single plane in the sheet.

6. The method as in claim 3, wherein each of the frame elements is linear.

7. The method as in claim 3, wherein the frame elements terminate in a mitered corner.

8. The method as in claim 3, wherein the providing step includes selecting an image which is in the public domain.

9. The method as in claim 8, wherein the copyright on the selected image has expired or lapsed.

* * * * *